US010376433B2

(12) United States Patent
Huang

(10) Patent No.: US 10,376,433 B2
(45) Date of Patent: Aug. 13, 2019

(54) ELECTRICALLY ADJUSTABLE BED

(71) Applicant: DK City Corporation, Taichung (TW)

(72) Inventor: Chia-Yen Huang, Taichung (TW)

(73) Assignee: DK CITY CORPORATION, Taichung (TW)

( * ) Notice: Subject to any disclaimer, the term of this patent is extended or adjusted under 35 U.S.C. 154(b) by 257 days.

(21) Appl. No.: 15/488,470

(22) Filed: Apr. 15, 2017

(65) Prior Publication Data

US 2018/0296412 A1 Oct. 18, 2018

(51) Int. Cl.
*A61G 7/018* (2006.01)
*A61G 7/015* (2006.01)

(52) U.S. Cl.
CPC ..... *A61G 7/018* (2013.01); *A61G 7/015* (2013.01)

(58) Field of Classification Search
CPC ..... A61G 7/002; A61G 7/005; A61G 7/012; A61G 7/015; A61G 7/018; A61G 13/02; A61G 13/04; A61G 13/06; A61G 13/08
USPC ..... 5/613, 616–618, 612, 600, 610
See application file for complete search history.

(56) References Cited

U.S. PATENT DOCUMENTS 912,588 A * 2/1909 Marseilles ..... A61H 1/0222 5/612
2,700,583 A * 1/1955 Davis ..... A61G 13/02 297/316
3,041,120 A * 6/1962 Burzlaff ..... A61G 13/00 5/614
3,041,121 A * 6/1962 Comper ..... A61G 13/00 5/618
3,041,122 A * 6/1962 Weickgenannt ..... A61G 13/00 5/614
3,281,141 A * 10/1966 Smiley ..... A61G 13/00 5/614
4,678,171 A * 7/1987 Sanders ..... A61G 13/12 5/618
6,874,182 B2 * 4/2005 L'Hegarat ..... A61G 13/08 5/612
7,089,612 B2 * 8/2006 Rocher ..... A61G 13/08 5/600
7,540,048 B2 * 6/2009 Piraino ..... A47C 7/462 5/612
7,587,770 B1 * 9/2009 Reser ..... A61G 13/009 128/845
7,690,057 B2 * 4/2010 Malassigne ..... A61G 1/0237 5/613
8,683,629 B2 * 4/2014 Clenet ..... A61G 7/015 5/613
9,706,848 B2 * 7/2017 Shih ..... A61G 7/015
2004/0083549 A1 * 5/2004 L'Hegarat ..... A61G 13/08 5/621

(Continued)

*Primary Examiner* — Robert G Santos
(74) *Attorney, Agent, or Firm* — Bruce Stone LLP; Joseph Bruce

(57) ABSTRACT

An adjustable bed includes a plank assembly, a support assembly, a frame and a power unit. The plank assembly includes a first waist plank and a second waist plank. The power unit is pivotally connected to the frame. The support assembly includes a waist-lifting unit that includes a first lifting element pivotally connected to a portion of the frame, a second lifting element pivotally connected to another portion of the frame, and a transmission unit operatively connected to the first and second lifting elements.

12 Claims, 13 Drawing Sheets

(56) References Cited

U.S. PATENT DOCUMENTS

| | | | | |
|---|---|---|---|---|
| 2006/0080777 | A1* | 4/2006 | Rocher | A61G 13/08 5/618 |
| 2007/0214571 | A1* | 9/2007 | Piraino | A47C 7/462 5/616 |
| 2008/0301875 | A1* | 12/2008 | Malassigne | A61G 1/0237 5/618 |
| 2009/0178201 | A1* | 7/2009 | Lujan | A47C 20/027 5/618 |
| 2013/0145553 | A1* | 6/2013 | Shih | A61G 7/015 5/624 |
| 2014/0000033 | A1* | 1/2014 | Clenet | A61G 7/015 5/618 |
| 2018/0103768 | A1* | 4/2018 | Nava | A47C 17/04 |
| 2018/0103769 | A1* | 4/2018 | Nava | A47C 17/04 |
| 2018/0103770 | A1* | 4/2018 | Nava | A47C 17/04 |
| 2018/0184811 | A1* | 7/2018 | Nava | A47C 17/04 |
| 2018/0296412 | A1* | 10/2018 | Huang | A61G 7/015 |
| 2018/0338625 | A1* | 11/2018 | Nava | A47C 21/028 |

* cited by examiner

ELECTRICALLY ADJUSTABLE BED

BACKGROUND OF INVENTION

1. Field of Invention

The present invention relates to an adjustable bed and, more particularly, to a lifting apparatus for an electrically adjustable bed.

2. Related Prior Art

As disclosed in EP1374821A1, FIGS. 4 through 7, an adjustable bed includes a support assembly 2, a back-lifting link 3, a knee-lift link 4 and interlocking means 9. The support assembly 2 includes a back support portion 2a, a waist support portion 2b, an upper leg support portion 2c, a lower leg support portion 2d, a bendable portion 2e between the back support portion 2a and the waist support portion 2b, and a bendable portion 2f between the upper leg support portion 2c and the lower leg support portion 2d. The back-lifting link 3 is in contact with the back support portion 2a. The knee-lifting link 4 is in contact with the upper leg support 2c or the lower leg support portion 2d. The interlocking means 9 includes a transmission arm 6 and a receiving arm 8. The transmission arm 6 is connected to a back-lifting shaft 5 of the back-lifting link 3. The receiving arm 8 is connected to a knee-lifting shaft 7 of the knee-lifting link 4. Thus, the back-lifting link 3 is connected to the knee-lifting link 4 by the interlocking means 9. However, there is no means for lifting the waist support portion 2b. Without such means, it is difficult to lift a patient's trunk without making the patient feel uncomfortable.

The present invention is therefore intended to obviate or at least alleviate the problems encountered in prior art.

SUMMARY OF INVENTION

It is the primary objective of the present invention to provide an adjustable that properly supports a user by the waist.

To achieve the foregoing objective, the adjustable bed includes a plank assembly, a support assembly, a frame and a power unit. The plank assembly includes a first waist plank and a second waist plank. The support assembly includes a waist-lifting unit that includes a first lifting element pivotally connected to the frame, a second lifting element pivotally connected to the frame, and a transmission unit. The transmission unit includes a shaft, two rocking levers, two swinging levers, two primary levers, two secondary levers, two arched elements, a movable element and two linkages. The power unit is arranged between the frame and the shaft. The rocking levers are connected to the shaft so that they can only be rotated together. The swinging levers are connected to the shaft at an end so that they can only be rotated together and pivotally connected to the frame at another end. Each of the primary levers is pivotally connected to a corresponding one of the rocking levers. Each of the secondary levers is connected to a corresponding one of the primary levers at an end and connected to the frame at another end. The movable element includes two crossbars and two longitudinal bars. The first crossbar is connected to the arched elements so that they can only be moved together. The longitudinal bars are pivotally connected to the first crossbar. The second crossbar is pivotally connected to the longitudinal bars. Each of the linkages connects the frame, a corresponding one of the arched elements and the first and second lifting elements to one another. When the power unit is at a minimum value of length, the waist-lifting unit is laid horizontally, the first waist plank is supported on the first crossbar of the movable element, and the second waist plank is supported on the second crossbar of the movable element and abutted against the frame. When the power unit extends, the swinging levers swing and hence move the rocking levers, and each of the secondary levers changes an angle between the corresponding primary lever and the corresponding arched element, thereby lifting the movable element and the first waist plank, abutting the second waist plank against the arched elements, and lifting the arched elements so that the first and second lifting elements are tilted relative to the frame. The linkages keep the arched elements horizontally when the arched elements are lifted so that the first and second lifting elements are tilted by substantially identical angles relative to the frame.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
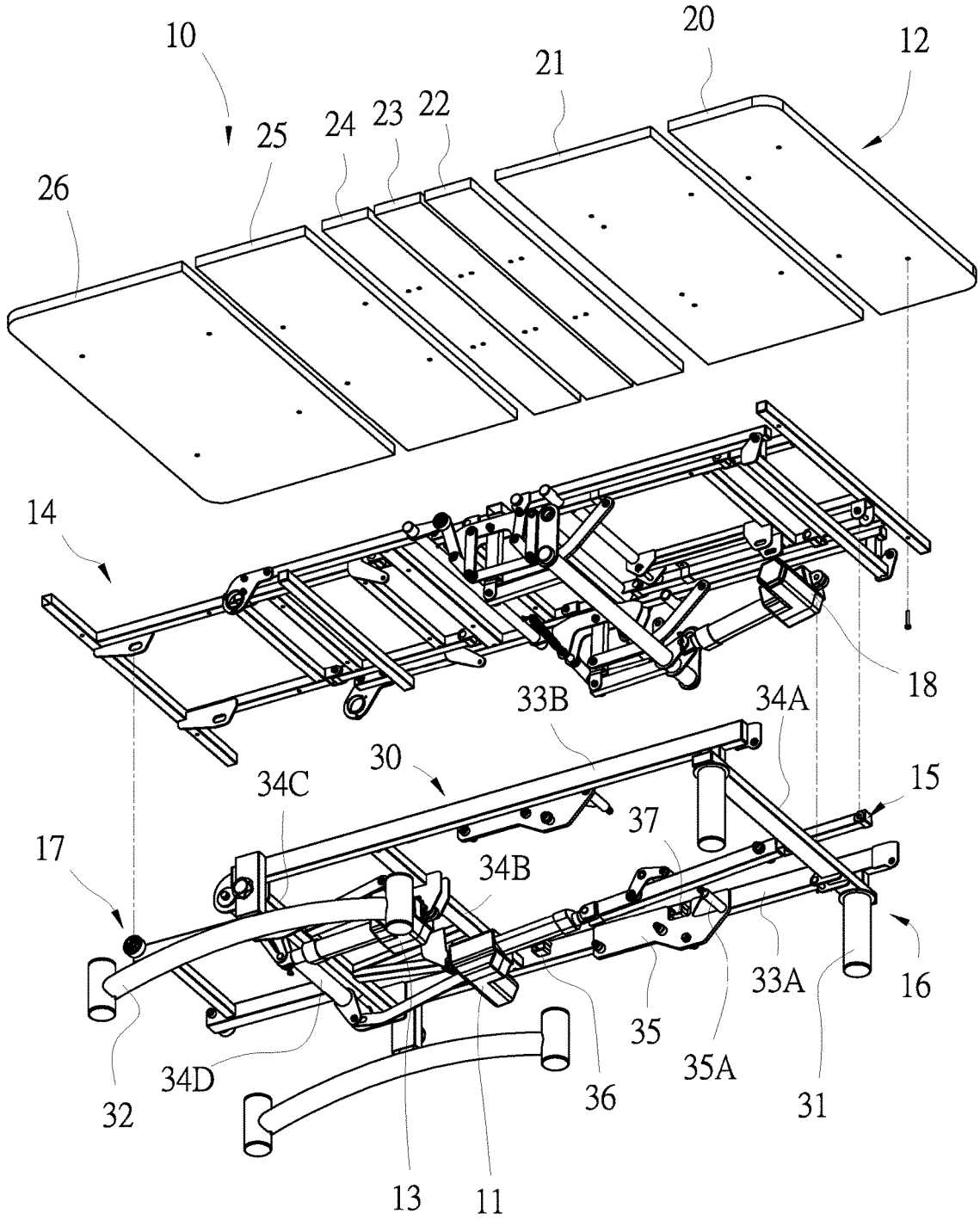
FIG. 1 is an exploded view of an electrically adjustable bed according to the preferred embodiment of the present invention.

Referring to FIG. 1, an electrically adjustable bed 10 includes a plank assembly 12, a support assembly 14 and a frame assembly 16 according to the preferred embodiment of the present invention. The plank assembly 12 is supported on the support assembly 14. The support assembly 14 is supported on the frame assembly 16.

The plank assembly 12 includes a head plank 20, a back plank 21, three waist planks 22, 23 and 24, an upper leg plank 25 and a lower leg plank 26. These planks 20 through 26 are substantially rectangular planks.

The frame assembly 16 includes a frame 30, two posts 31 and two pairs of posts 32. The frame 30 includes two longitudinal bars 33A and 33B, three crossbars 34A, 34B and 34C and a transverse axle 34D. The crossbars 34A, 34B and 34C are provided between the longitudinal bars 33A and 33B. The transverse axle 34D is connected to the crossbar 34C. A connective plate 35 is connected to an internal side of each of the longitudinal bars 33A and 33B. Two brackets 36 and 37 are connected to the internal side of each of the longitudinal bars 33A and 33B. An axle 35A is connected to an internal side of each of the connective plates 35. On the internal side of each of the connective plates 35, there are several connective elements such as threaded bolts, rivets, pins or any other fasteners. In each pair, the posts 32 are connected to each other by a beam.

Figure 2:
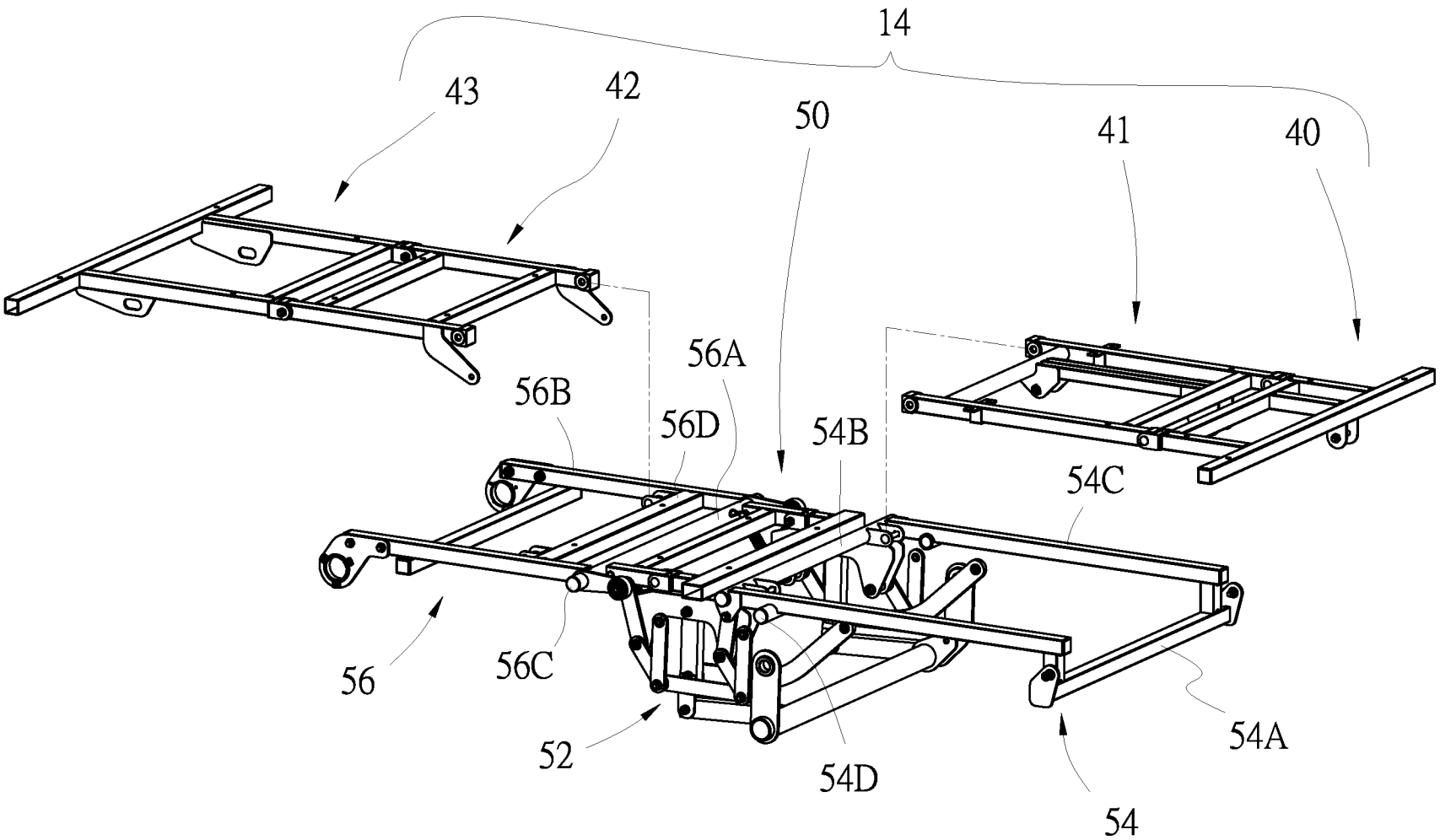
FIG. 2 is an exploded view of a support assembly of the electrically adjustable bed shown in FIG. 1.

Referring to FIG. 2, the support assembly 14 includes a head plank-supporting element 40, a back plank-supporting element 41, an upper leg plank-supporting element 42, a lower leg plank-supporting element 43, and a waist-lifting unit 50. The back plank-supporting element 41 is pivotally connected to a portion of the waist-lifting unit 50. The head plank-supporting element 40 is pivotally connected to the back plank-supporting element 41. The upper leg plank-supporting element 42 is pivotally connected to another portion of the waist-lifting unit 50. The lower leg plank-supporting element 43 is pivotally connected to the upper leg plank-supporting element 42. The head plank-supporting element 40, the back plank-supporting element 41, the upper leg plank-supporting element 42 and the lower leg plank-supporting element 43 will not be described in detail for being similar to the frame 30.

The waist-lifting unit 50 includes a transmission unit 52 and two lifting elements 54 and 56. The lifting elements 54 and 56 are in the form of a rectangular frame.

Figure 5:
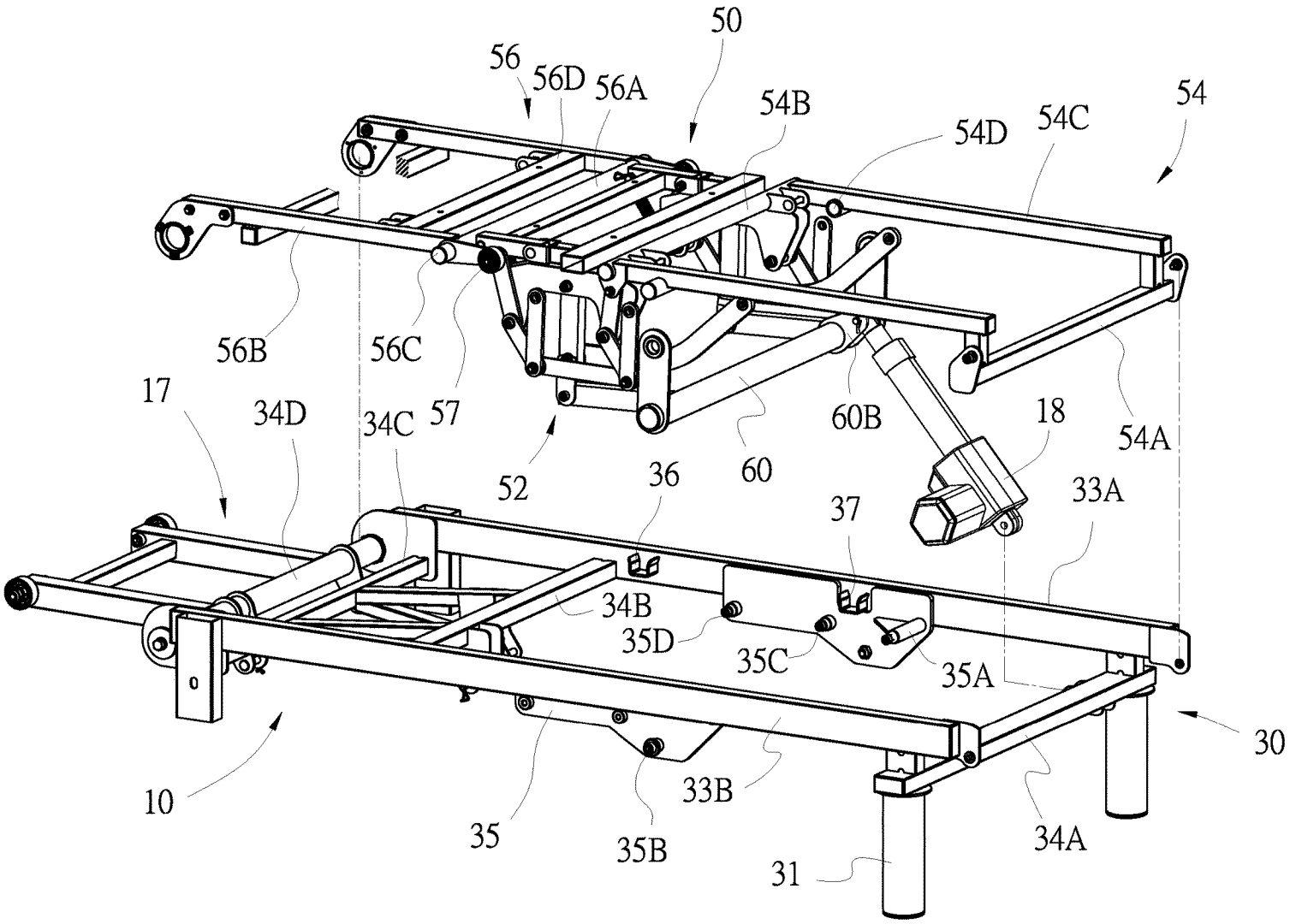
FIG. 5 is a perspective view of a back-lifting assembly of the electrically adjustable bed shown in FIG. 1.
Figure 6:
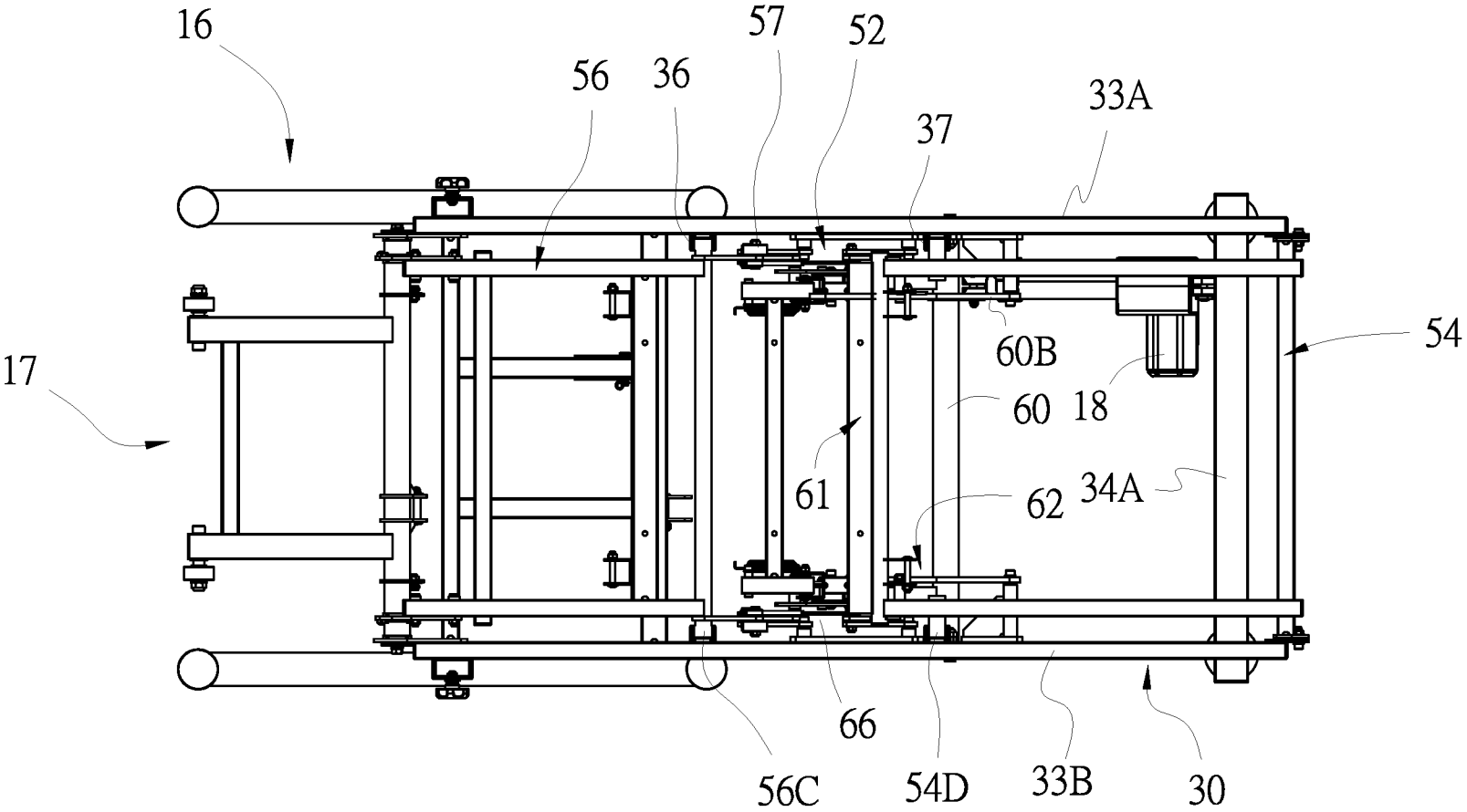
FIG. 6 is a top view of the back-lifting assembly shown in FIG. 5.
Figure 7:
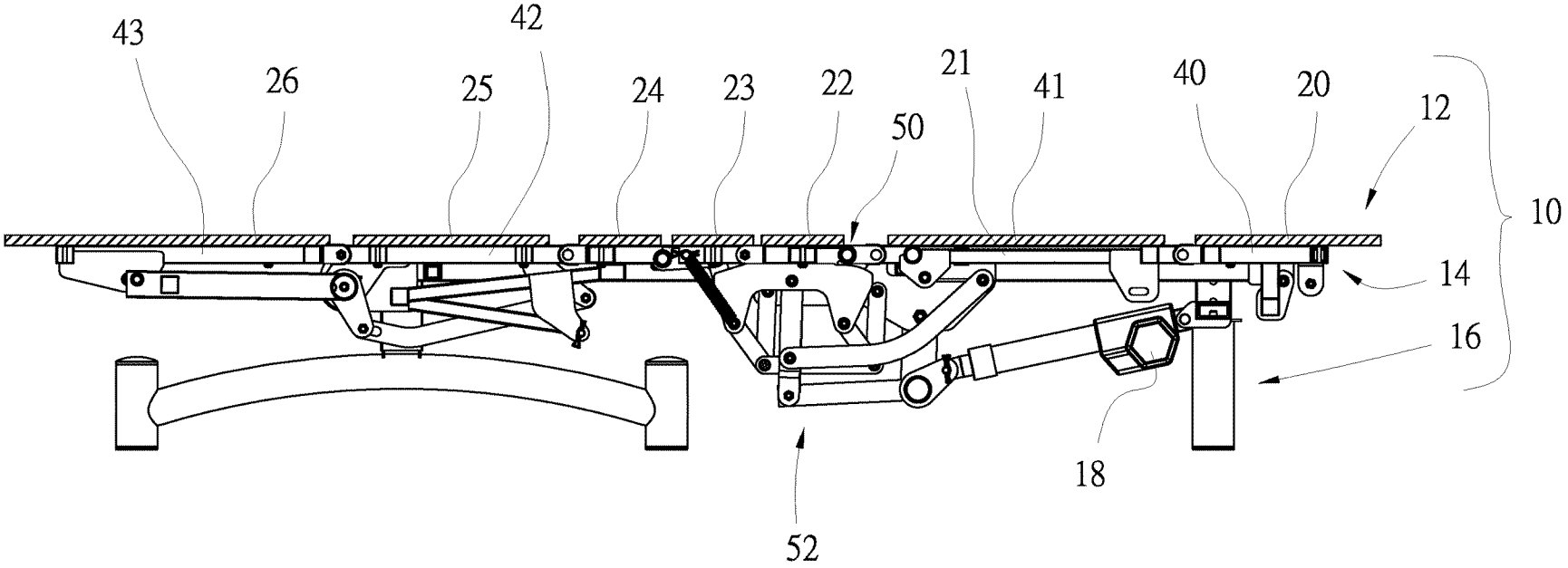
FIG. 7 is a side view of the electrically adjustable bed shown in FIG. 1, in a lowered position.
Figure 8:
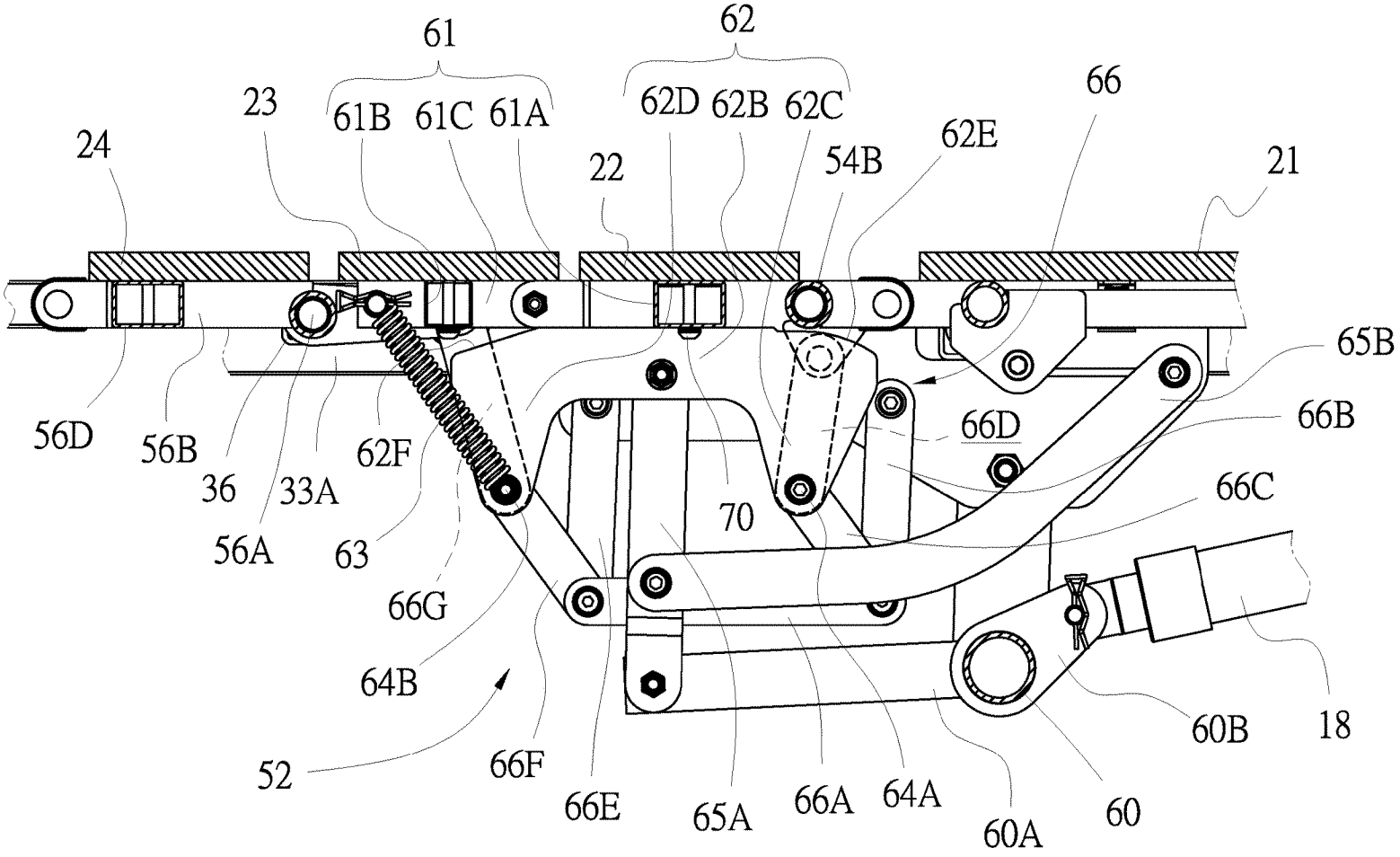
FIG. 8 is an enlarged partial view of the electrically adjustable bed shown in FIG. 7.

Referring to FIGS. 5 and 6, the lifting element 54 includes two crossbars 54A and 54B, two longitudinal bars 54C and two transverse bars 54D. The crossbars 54A and 54B are connected to the longitudinal bars 54C by welding for example. Each of the transverse bars 54D is connected to a corresponding one of the longitudinal bars 54C. Each of the transverse bars 54D extends beyond an external face of the corresponding longitudinal bar 54C. Two ends of the crossbar 54A are pivotally connected to the longitudinal bars 33A and 33B of the frame 30 and the transverse bars 54D are supported on the brackets 37 so that the lifting element 54 is laid horizontally in the frame 30.

The lifting element 56 includes two crossbars 56A and 56D, two longitudinal bars 56B and two transverse bars 56C. The crossbars 56A and 56D are connected to the longitudinal bars 56B by welding for example. Each of the transverse bars 56C is connected to a corresponding one of the longitudinal bars 56B. The transverse bars 56C are in fact two sections of the crossbars 56A that extend beyond the longitudinal bars 56B. Two ends of the longitudinal bars 56B are pivotally connected to the transverse axle 34D and the transverse bars 56C are supported on the brackets 36 so that the lifting element 56 is laid horizontally in the frame 30 opposite to the lifting element 54.

Figure 3:
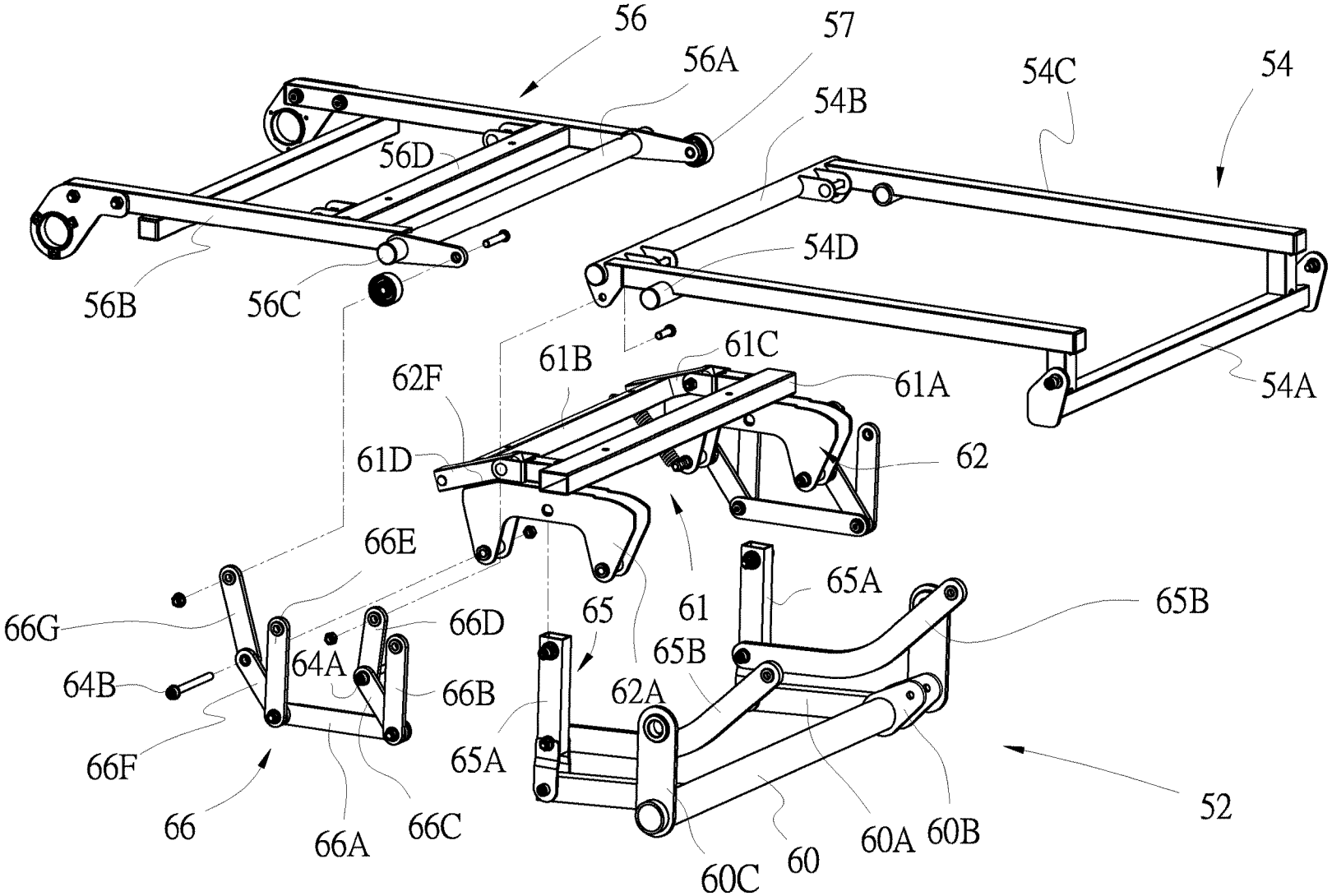
FIG. 3 is another exploded view of a support assembly of the electrically adjustable bed shown in FIG. 2.
Figure 4:
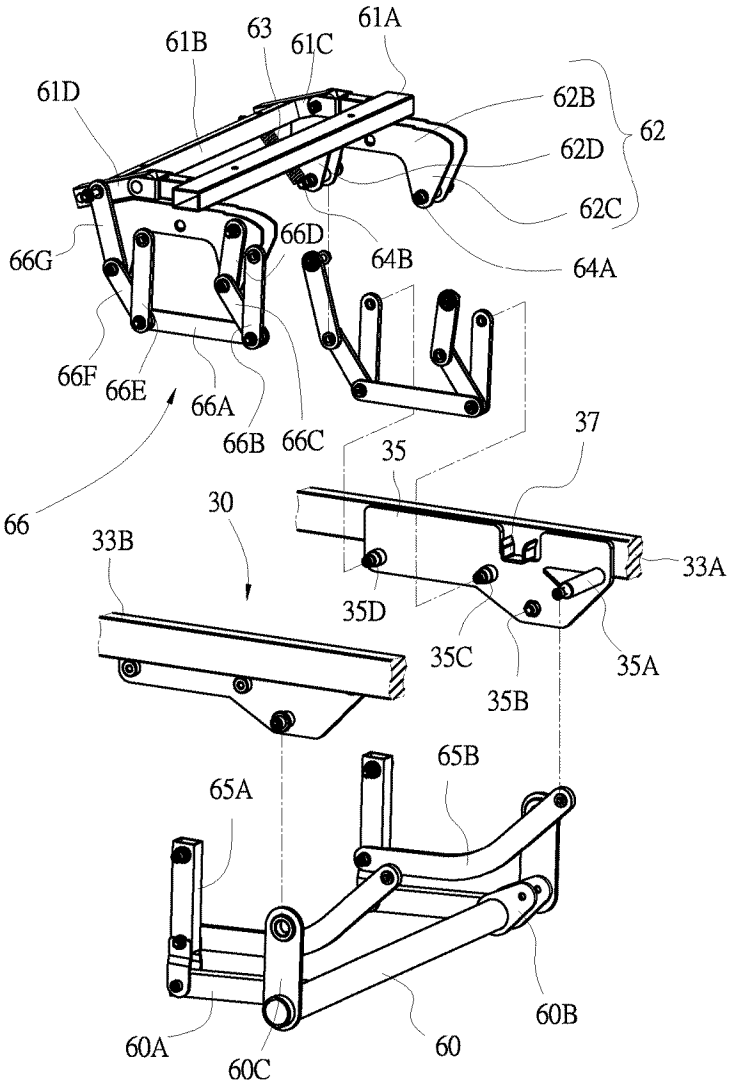
FIG. 4 is an exploded view of a transmission unit and a portion of the support assembly shown in FIG. 3.

Referring to FIGS. 3 and 4, the transmission unit 52 includes a shaft 60, a movable element 61, two arched elements 62, two elastic elements 63, two linkages 65 and two linkages 66. The shaft 60 includes two rocking levers 60A, a lug 60B and two swinging levers 60C. The rocking levers 60A, the lug 60B and the swinging levers 60C are connected to shaft 60 by welding for example so that they can only be rotated together.

Each of the linkages 65 includes a primary lever 65A and a secondary lever 65B. The primary lever 65A is a rectilinear element. The secondary lever 65B is a bent element formed with an end pivotally connected to a corresponding one of the axles 35A.

An end of each of the rocking levers 60A is connected to the shaft 60. Another end of each of the rocking levers 60A is pivotally connected to an end of a corresponding one of the primary levers 65A.

An end of each of the swinging levers 60C is pivotally connected to the shaft 60. Another end of each of the swinging levers 60C is connected to a corresponding one of the connective plates 35 via a connective element 35B.

The movable element 61 includes two crossbars 61A and 61B and two longitudinal bars 61C and 61D. The longitudinal bars 61C and 61D are pivotally connected to two extensive portions (not numbered) of the crossbar 61A. The longitudinal bars 61C and 61D are connected to the crossbar 61B by welding for example so that they can only be rotated together.

Figure 10:
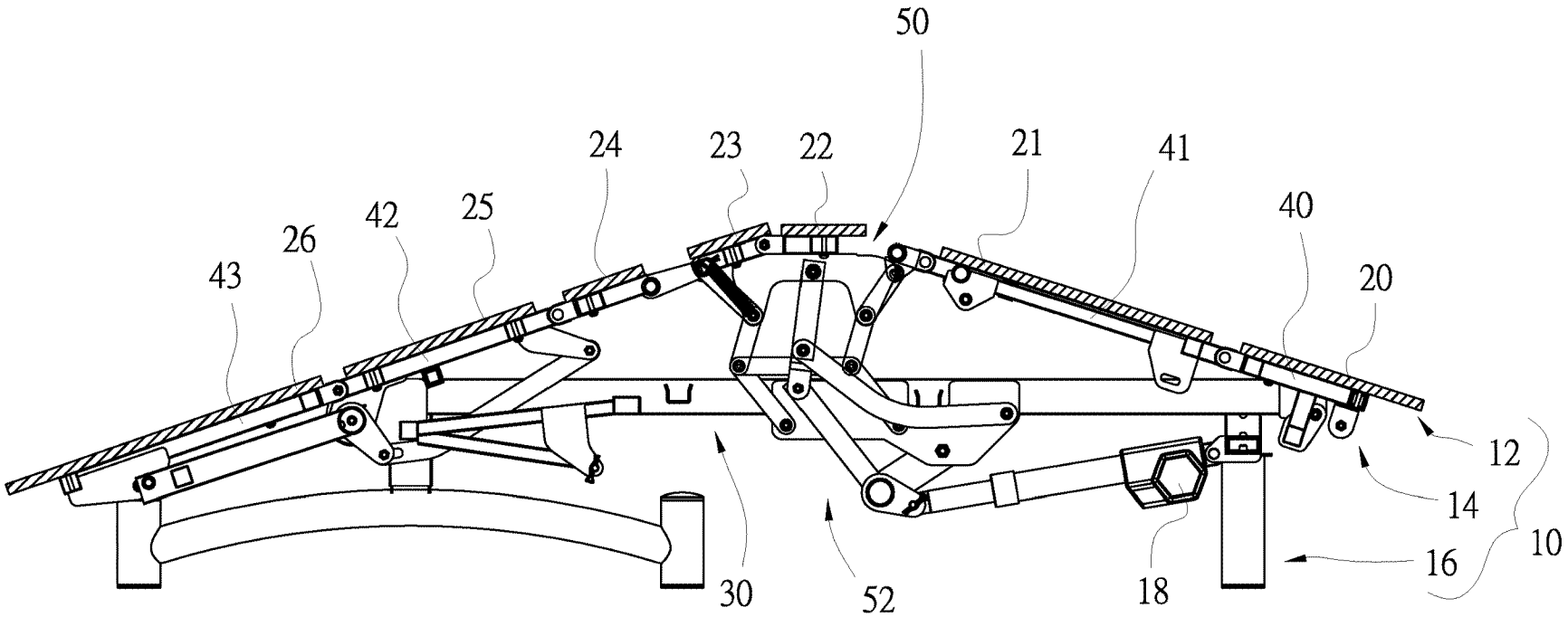
FIG. 10 is a side view of the electrically adjustable bed shown in FIG. 1, in another position.
Figure 11:
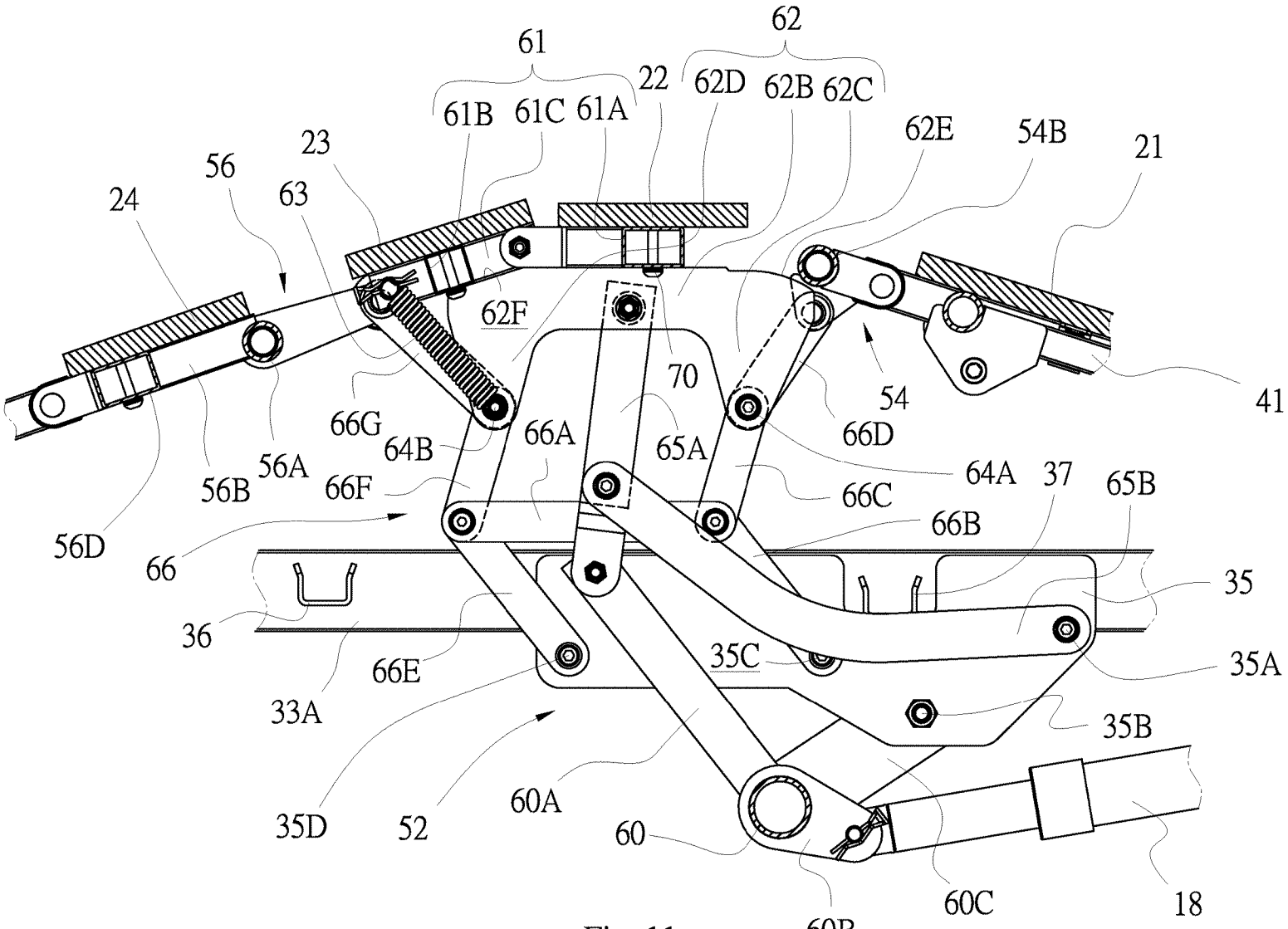
FIG. 11 is an enlarged partial view of the electrically adjustable bed shown in FIG. 10.

Each of the arched elements 62 includes two strips 62A that are parallel and connected to each other. Each of the arched elements 62 includes a horizontal section 62B formed between two vertical sections 62C and 62D. The horizontal section 62B includes an arched face 62E above the vertical section 62C and an inclined face 62F above the vertical section 62D (FIGS. 10 and 11). The horizontal sections 62B of the arched elements 62 are pivotally connected to free ends of the primary levers 65A of the linkages 65, thereby rendering the arched elements 62 movable with the shaft 60 and the movable element 61.

The crossbar 61A is connected to the horizontal section 62B of the arched elements 62 by welding for example. The longitudinal bars 61C and 61D and the crossbar 61B are movably laid on the inclined face 62F.

The elastic elements 63 are preferably tensile springs. One of the elastic elements 63 includes an end connected to the longitudinal bar 61C and another end connected to a connecting element 64B that is partially inserted in the vertical section 62D of one of the arched elements 62. The other elastic element 63 includes an end connected to the longitudinal bar 61D and another end connected to another connecting element 64B that is partially inserted in the vertical section 62D of the other arched element 62. The elastic elements 63 tend to press the movable element 61 against the inclined face 62F.

Each of the linkages 66 includes two sub-linkages connected to each other by a main linking element 66A, thereby limiting the pivoting of the movable element 61 and the arched elements 62 relative to the frame 30.

The first sub-linkage includes three linking elements 66B, 66C and 66D. A first end of the linking element 66B is pivotally connected to a corresponding one of the connective plates 35 via a connective element 35C. A second end of the linking element 66B is pivotally connected to a first end of the linking element 66C and a first end of the main linking element 66A. A second end of the linking element 66C is pivotally connected to a first end of the linking element 66D and the vertical section 62C of the corresponding arched element 62. A second end of the linking element 66D is pivotally connected to a corresponding end of the crossbar 54B of the lifting element 54.

The second sub-linkage includes three linking elements 66E, 66F and 66G. A first end of the linking element 66E is pivotally connected to a corresponding one of the connective plates 35 via another connective element 35D. A second end of the linking element 66E is pivotally connected to a first end of the linking element 66F and a second end of the main linking element 66A. A second end of the linking element 66F is pivotally connected to a first end of the linking element 66G and the vertical section 62D of the corresponding arched element 62. A second end of the linking element 66G is pivotally connected to a corresponding corner of the lifting element 56 by a roller 57.

Referring to FIG. 1, the electrically adjustable bed 10 further includes three power units 11, 13 and 18 on the frame assembly 16. Each of the power units 11, 13 and 18 are based on an electric motor operable to control the effective total length.

Referring to FIG. 5, the power unit 18 includes an end pivotally connected to the lug 60B of the shaft 60 and another end pivotally connected to the crossbar 34A of the frame 30. The power unit 18 is operable to drive the waist-lifting unit 50.

Referring to FIGS. 6 through 9, the waist-lifting unit 50 is in a horizontal position when the effective total length of the power unit 18 is at a minimum value. Thus, the primary levers 65A extend substantially parallel to the horizontal sections 62B of the arched elements 62. The arched elements 62 are moved and the horizontal sections 62B are kept horizontally because of the vertical sections 62C and 62D and the linking elements 66C and 66F.

Fasteners 70 such as screws or threaded bolts are used to secure the first waist plank 22 to the crossbar 61A, the second waist plank 23 to the crossbar 61B and short bar 61D, and the third waist plank 24 to the crossbar 56D or the longitudinal bar 56B of the lifting element 56. The longitudinal bars 33A and 33B of the frame 30 stop the second waist plank 23, against the elastic elements 63. Thus, the longitudinal bars 61C and 61D of the movable element 61 are kept from the inclined faces 62F of the arched elements 62 when the waist-lifting unit 50 is in the horizontal position.

Synchronously, about the connecting elements 64A, the linking elements 66D move the crossbar 54B of the lifting element 54 to a place between the first waist plank 22 and the arched faces 62E, not in contact with the arched elements 62. Moreover, about the connecting elements 64B, the linking elements 66G move the roller 57 below the second waist plank 23, not in contact with the second waist plank 23.

Referring to FIGS. 10 and 11, the power unit 18 extends and hence moves the rocking lever 60A via the lug 60B. The swinging levers 60C limit the movement of the rocking levers 60A to an arch with a radius identical to a distance between the connective element 35B and the shaft 60. About the axle 35A, with a distance between the ends of the secondary lever 65B taken as a radius, the angle between primary lever 65A and the arched elements 62 is changed so that the movable element 61 and first waist plank 22 are lifted.

Guided by the main linking elements 66A, the linking elements 66B and 66C of the first sub-linkage and the linking elements 66E and 66F of the second sub-linkage are moved synchronously so that the arched elements 62 are lifted. The crossbar 54B is moved out of a gap between the first waist plank 22 and the arched elements 62 along the arched face 62E, about the connecting element 64A, with a linear distance between the ends of the linking elements 66D as a radius. Similarly, the lifting element 56 is tilted relative to the frame 30, about the connecting element 64B, with a linear distance between the ends of the linking elements 66G as a radius.

Figure 9:
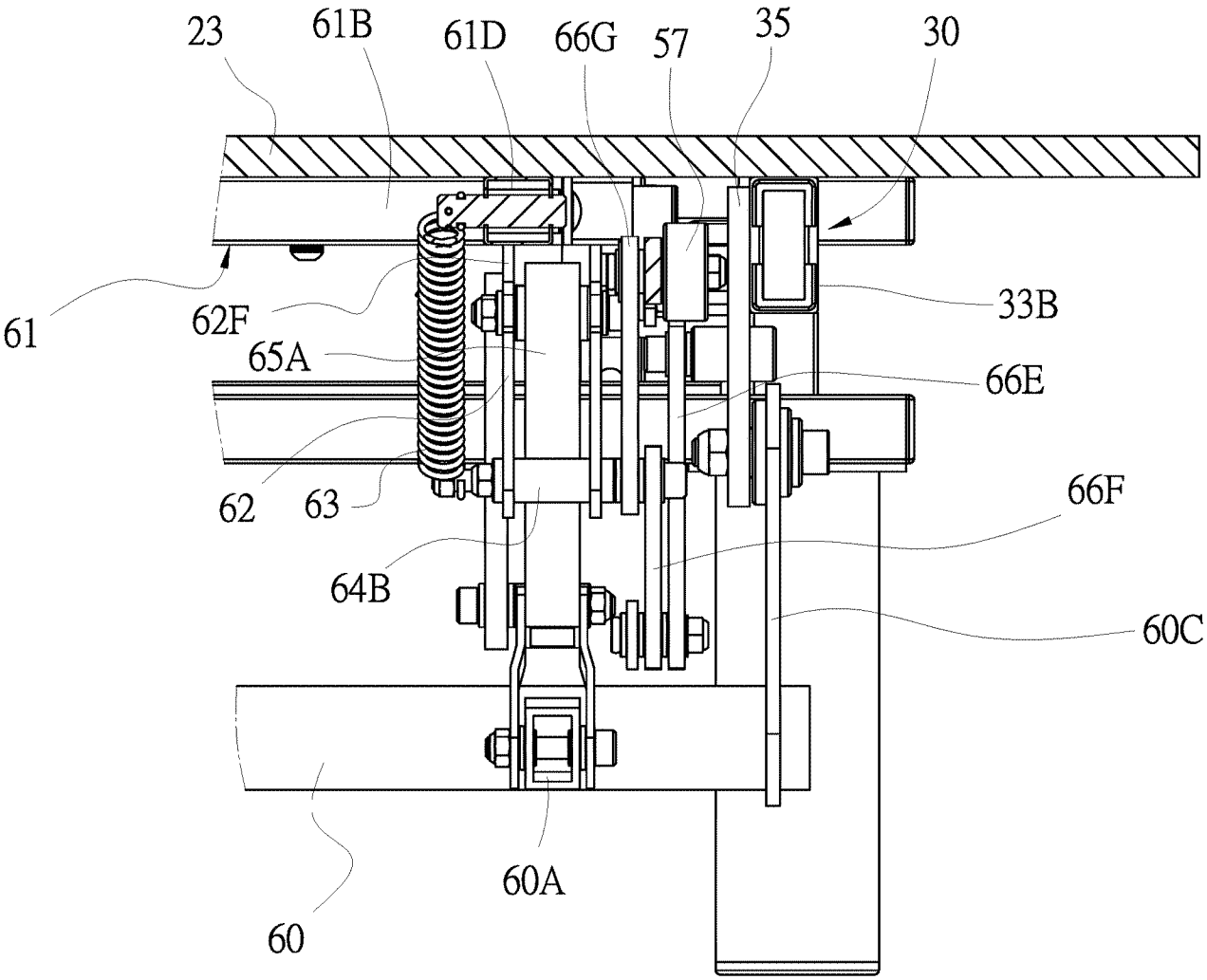
FIG. 9 is a front view of the portion of the electrically adjustable bed shown in FIG. 8.

The longitudinal bars 33A of the frame 30 no longer stop the second waist plank 23. However, the elastic elements 63 move the longitudinal bars 61C toward the inclined faces 62F, thereby abutting the second waist plank 23 against the roller 57 (FIG. 9). Similarly, about the connecting element 64B, the linking elements 66G keep the lifting element 56 in the inclined position. When the waist-lifting unit 50 is lifted, the transverse bars 54D of the lifting element 54 will be moved from the bracket 36 and the transverse bars 56C of the lifting element 56 will be moved from the bracket 37 (FIG. 5).

Figure 12:
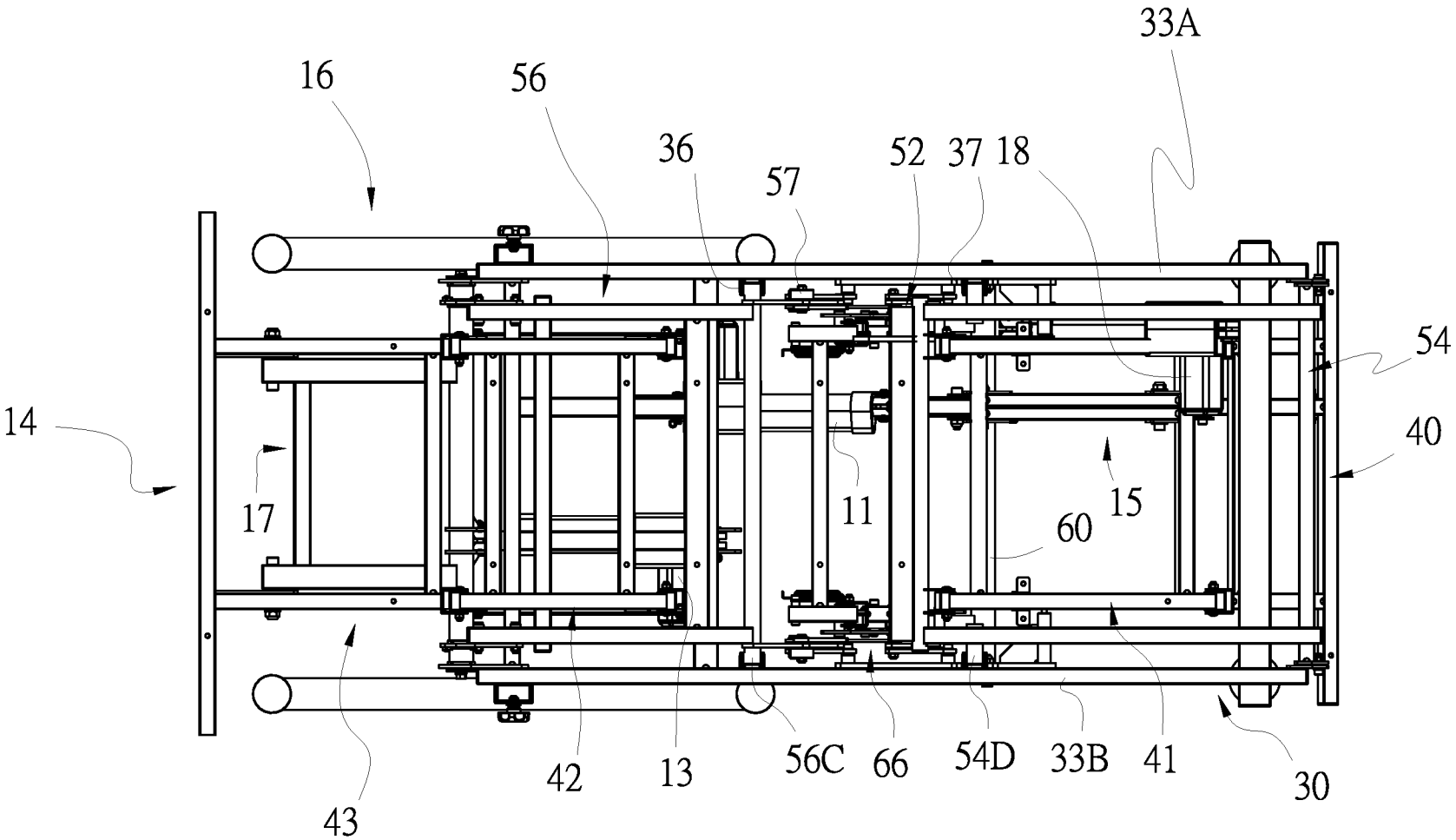
FIG. 12 is a top view of the electrically adjustable bed shown in FIG. 1.

Referring to FIGS. 2 and 12, the head plank-supporting element 40 is pivotally connected to an end of the back plank-supporting element 41 and the crossbar 54B of the lifting element 54 is pivotally connected to another end of the back plank-supporting element 41. Hence, the head plank-supporting element 40 and the back plank-supporting element 41 are allowed to swing in the lifting element 54. The lower leg plank-supporting element 43 is pivotally connected to an end of the upper leg plank-supporting element 42 and the crossbar 56D of the lifting element 56 is pivotally connected to another end of the upper leg plank-supporting element 42. Hence, the upper leg plank-supporting element 42 and the lower leg plank-supporting element 43 are allowed to move to and fro in the lifting element 56.

Figure 13:
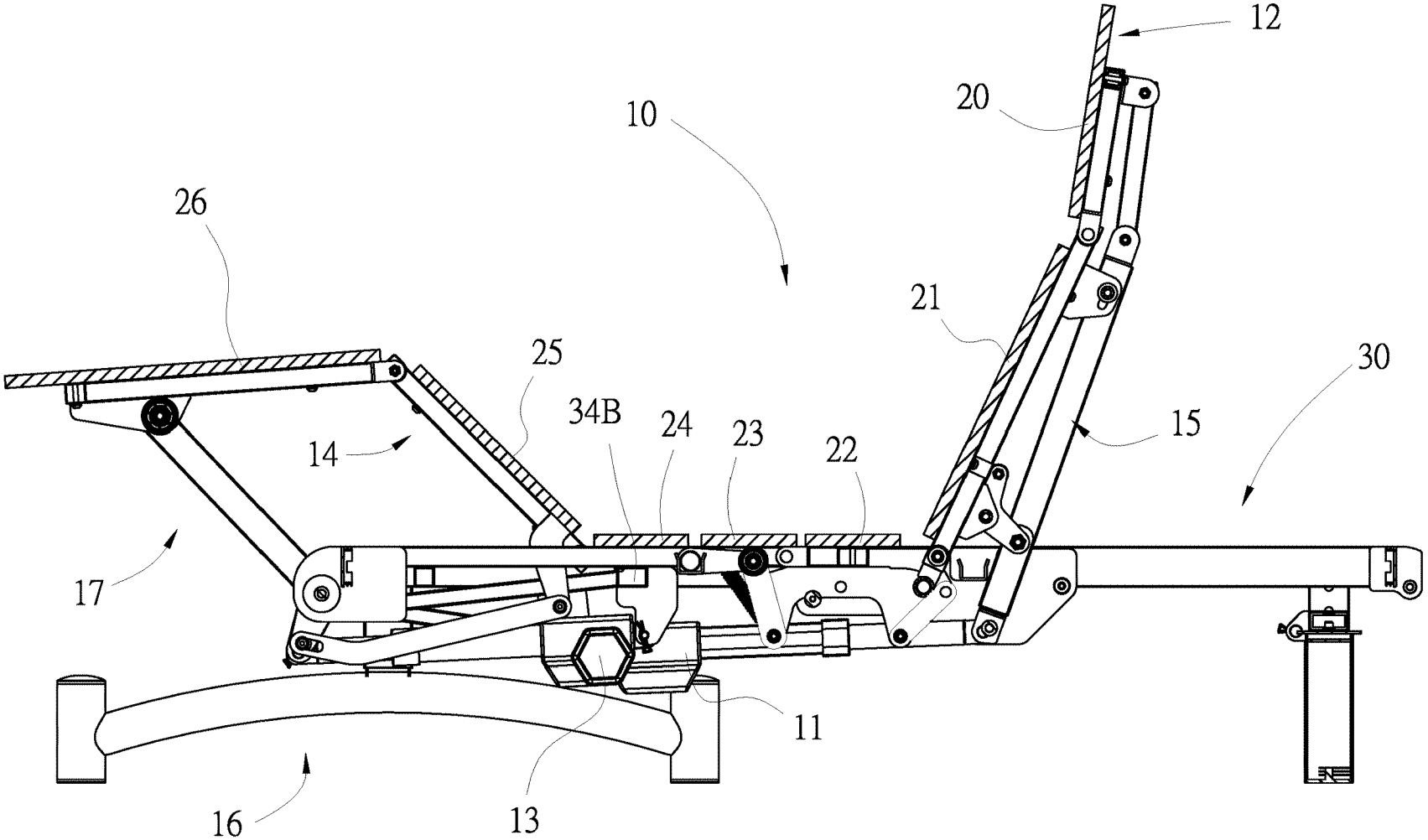
FIG. 13 is a side view of the electrically adjustable bed shown in FIG. 1, in another position.

Referring to FIGS. 1, 2 and 13, the power unit 11 is pivotally arranged between the crossbars 34B of the frame 30 and a transmission unit 15 for a back plank-supporting element 41. The transmission unit 15 is connected to lower faces of the back plank-supporting element 41 and the head plank-supporting element 40, operable to lift the back plank-supporting element 41 and head plank-supporting element 40 to an angle.

Similarly, the power unit 13 is pivotally connected to the crossbars 34B of the frame 30, in a different sense of direction from the power unit 11. A transmission unit 17 for a lower leg plank-supporting element 45 is connected to the transverse axle 34D of the frame 30, thereby connecting the power unit 13 to the lower leg plank-supporting element 43, operable to lift the upper leg plank-supporting element 42 and lower leg plank-supporting element 43 to an angle.

Details of the transmission units 15 and 17 are given in Taiwanese Patent Application Publication Nos. 105215442 and 105215443. Hence, the transmission units 15 and 17 will not be described in detail.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. An adjustable bed comprising:

a plank assembly comprising a first waist plank and a second waist plank;

a frame;

a power unit pivotally connected to the frame;

a support assembly comprising a waist-lifting unit comprising a first lifting element pivotally connected to the frame, a second lifting element pivotally connected to the frame, and a transmission unit comprising:

a shaft operatively connected to the power unit;

two rocking levers connected to the shaft so that they can only be rotated together;

two swinging levers connected to the shaft at an end so that they can only be rotated together and pivotally connected to the frame at another end;

two primary levers each pivotally connected to a corresponding one of the rocking levers;

two secondary levers each connected to a corresponding one of the primary levers at an end and connected to the frame at another end;

two arched elements;

a movable element comprising a first crossbar connected to the arched elements so that they can only be moved together, two longitudinal bars pivotally connected to the first crossbar, and a second crossbar pivotally connected to the longitudinal bars; and two linkages each for connecting the frame, a corresponding one of the arched elements and the first and second lifting elements to each other;

wherein when the power unit is at a minimum value of length, the waist-lifting unit is laid horizontally, the first waist plank is supported on the first crossbar of the movable element, and the second waist plank is supported on the second crossbar of the movable element and abutted against the frame;

wherein when the power unit extends, the swinging levers swing and hence move the rocking levers, and each of the secondary levers changes an angle between the corresponding primary lever and the corresponding arched element, thereby lifting the movable element and the first waist plank, abutting the second waist plank against the arched elements, and lifting the arched elements so that the first and second lifting elements are tilted relative to the frame;

wherein the linkages keep the arched elements horizontally when the arched elements are lifted so that the first and second lifting elements are tilted by substantially identical angles relative to the frame.

2. The adjustable bed according to claim 1, wherein the frame comprises two longitudinal bars and two crossbars connected to the longitudinal bars thereof.

3. The adjustable bed according to claim 2, wherein each of the longitudinal bars comprises two brackets formed thereon, the first lifting element comprises two transverse bars formed thereon, and the second lifting element comprises two transverse bars formed thereon, the transverse bars are supported on the brackets when the waist-lifting unit is laid horizontally, and the transverse bars are moved from the brackets when the movable element is lifted by the primary levers.

4. The adjustable bed according to claim 1, wherein each of the arched elements comprises a first vertical sections connected to a corresponding one of the linkages, a second vertical section connected to the corresponding linkage and a horizontal section formed on the first and second vertical sections.

5. The adjustable bed according to claim 4, wherein the horizontal section of each of the arched elements comprises an arched face and an inclined face corresponding to the first and second vertical sections.

6. The adjustable bed according to claim 4, wherein each of the arched elements comprises two strips that are parallel and connected to each other.

7. The adjustable bed according to claim 5, further comprising two elastic elements arranged between the movable element and the arched elements, thereby biasing the movable element toward the inclined faces of the arched elements.

8. The adjustable bed according to claim 7, wherein each of the elastic elements comprises an end connected to a corresponding one of the longitudinal bars and one of the vertical sections of the corresponding arched element.

9. The adjustable bed according to claim 7, wherein the elastic elements are tensile springs.

10. The adjustable bed according to claim 4, wherein each of the linkages comprises:

a first sub-linkage connected to the first vertical section of the corresponding arched element;

a second sub-linkage connected to the second vertical section of the corresponding arched element; and a main linking element for interconnecting the first and second sub-linkages, thereby limiting the movement of the movable element and the arched elements relative to the frame.

11. The adjustable bed according to claim 10, wherein the main linking element comprises a first end and a second end;

wherein the first sub-linkage comprises:

a first linking element comprising a first end pivotally connected to the frame;

a second linking element comprising a first end pivotally connected to a second end of the first linking element and the first end of the main linking element; and a third linking element comprising a first end pivotally connected to a second end of the second linking element and the first vertical section of the corresponding arched element and a second end pivotally connected to the first lifting element;

wherein the second sub-linkage comprises:

a first linking element comprising a first end pivotally connected to the frame;

a second linking element comprising a first end pivotally connected to a second end of the first linking element of the second sub-linkage and the second end of the main linking element; and a third linking element comprising a first end pivotally connected to a second end of the second linking element of the second sub-linkage and the second vertical section of the corresponding arched element and a second end pivotally connected to the second lifting element.

12. The adjustable bed according to claim 11, wherein the second sub-linkage further comprises a roller for sup porting the third linking element thereof on the second lifting element.

* * * * *